US008874021B2

(12) United States Patent
Sakaya et al.

(10) Patent No.: US 8,874,021 B2
(45) Date of Patent: Oct. 28, 2014

(54) MEDIA GUIDE MECHANISM, FIXING DEVICE AND IMAGE FORMING APPARATUS INCORPORATING SAME

(75) Inventors: Kohta Sakaya, Hyogo (JP); Yasuhide Ohkubo, Osaka (JP); Tamotsu Ikeda, Osaka (JP); Yoshiharu Takahashi, Osaka (JP); Chikara Hiraoka, Osaka (JP); Toshio Ogiso, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 170 days.

(21) Appl. No.: 13/535,931

(22) Filed: Jun. 28, 2012

(65) Prior Publication Data

US 2013/0004222 A1 Jan. 3, 2013

(30) Foreign Application Priority Data

Jun. 30, 2011 (JP) ..... 2011-146135

(51) Int. Cl.
*G03G 15/20* (2006.01)
*B65H 5/36* (2006.01)
*B65H 5/06* (2006.01)

(52) U.S. Cl.
CPC ..... *G03G 15/2028* (2013.01); *B65H 2515/81* (2013.01); *B65H 2402/24* (2013.01); *B65H 5/062* (2013.01); *B65H 5/36* (2013.01); *B65H 2511/212* (2013.01)
USPC ..... 399/400

(58) Field of Classification Search
CPC .. B65H 2220/08; B65H 2515/81; B65H 5/36; G03G 15/2028; G03G 15/20
USPC ..... 399/400, 67–69, 322, 300
See application file for complete search history.

(56) References Cited

U.S. PATENT DOCUMENTS

| | | | | |
|---|---|---|---|---|
| 5,771,434 | A * | 6/1998 | Hokari | 399/400 |
| 6,108,514 | A * | 8/2000 | Nakayama et al. | 399/400 |
| 7,676,176 | B2 | 3/2010 | Fujiwara et al. | |
| 7,677,555 | B2 | 3/2010 | Tanaka et al. | |
| 7,769,332 | B2 | 8/2010 | Yamamoto et al. | |
| 7,831,186 | B2 | 11/2010 | Obata et al. | |
| 7,878,725 | B2 | 2/2011 | Ohkubo et al. | |
| 7,953,361 | B2 | 5/2011 | Obata et al. | |
| 7,992,860 | B2 | 8/2011 | Kimura et al. | |
| 8,090,303 | B2 | 1/2012 | Hayashi et al. | |
| 8,107,864 | B2 | 1/2012 | Saito et al. | |

(Continued)

FOREIGN PATENT DOCUMENTS

| | | | | |
|---|---|---|---|---|
| JP | 59-212865 | A | 12/1984 | |
| JP | 11011739 | A * | 1/1999 | G03G 5/36 |

(Continued)

*Primary Examiner* — Nguyen Ha
(74) *Attorney, Agent, or Firm* — Harness, Dickey & Pierce, P.L.C.

(57) ABSTRACT

A mechanism for guiding a recording medium into a nip formed between a first rotary member subjected to heating, and a second rotary member pressed against the first rotary member includes a guide member and a biasing member. The guide member is disposed upstream from the nip to guide the recording medium therealong. The biasing member is connected to the guide member to mechanically bias the guide member. The guide member is subjected to a constant biasing force from the biasing member and to a pressure force from the recording medium. The pressure force is opposite the biasing force and variable with a stiffness of the recording medium being guided. The guide member is movable to different operational positions depending on the biasing and pressure forces acting thereon.

17 Claims, 5 Drawing Sheets

(56) References Cited

U.S. PATENT DOCUMENTS

| | | | | |
|---|---|---|---|---|
| 8,135,298 | B2 | 3/2012 | Ogiso et al. | |
| 2003/0190175 | A1* | 10/2003 | Pitts et al. | 399/322 |
| 2004/0218953 | A1* | 11/2004 | Gross et al. | 399/400 |
| 2007/0059071 | A1* | 3/2007 | Shinshi et al. | 399/400 |
| 2007/0065201 | A1 | 3/2007 | Fujiwara et al. | |
| 2007/0285701 | A1 | 12/2007 | Ohta et al. | |
| 2008/0006166 | A1 | 1/2008 | Ohkubo et al. | |
| 2008/0013993 | A1 | 1/2008 | Obata et al. | |
| 2008/0056783 | A1 | 3/2008 | Yamamoto et al. | |
| 2008/0069611 | A1 | 3/2008 | Obata et al. | |
| 2008/0317532 | A1* | 12/2008 | Ehara et al. | 399/400 |
| 2009/0022514 | A1 | 1/2009 | Fujiwara et al. | |
| 2009/0110418 | A1 | 4/2009 | Ogiso et al. | |
| 2009/0110449 | A1 | 4/2009 | Saito et al. | |
| 2009/0121418 | A1 | 5/2009 | Tanaka et al. | |
| 2009/0129836 | A1 | 5/2009 | Sakaya et al. | |
| 2009/0162772 | A1 | 6/2009 | Fuwa et al. | |
| 2009/0174135 | A1 | 7/2009 | Tanaka et al. | |
| 2009/0190949 | A1 | 7/2009 | Hamahashi et al. | |
| 2009/0238585 | A1 | 9/2009 | Hayashi et al. | |
| 2009/0290893 | A1 | 11/2009 | Ogiso et al. | |
| 2009/0302521 | A1 | 12/2009 | Kondo et al. | |
| 2009/0315250 | A1 | 12/2009 | Kimura et al. | |
| 2010/0034548 | A1 | 2/2010 | Naitoh et al. | |
| 2010/0054785 | A1 | 3/2010 | Ogiso et al. | |
| 2010/0061741 | A1* | 3/2010 | Minbu | 399/21 |
| 2010/0086334 | A1 | 4/2010 | Sakaya | |
| 2010/0192710 | A9 | 8/2010 | Hanashima et al. | |
| 2010/0239297 | A1 | 9/2010 | Sakaya et al. | |
| 2010/0260524 | A1 | 10/2010 | Hiraoka et al. | |
| 2011/0188874 | A1 | 8/2011 | Takahashi et al. | |
| 2011/0188896 | A1 | 8/2011 | Sakaya et al. | |
| 2011/0194864 | A1 | 8/2011 | Nakatake et al. | |
| 2011/0217055 | A1 | 9/2011 | Takehara et al. | |
| 2011/0221126 | A1 | 9/2011 | Ohkubo | |
| 2012/0002997 | A1 | 1/2012 | Hiraoka et al. | |
| 2012/0020681 | A1 | 1/2012 | Naitoh et al. | |
| 2012/0033997 | A1 | 2/2012 | Fujita et al. | |
| 2012/0045241 | A1 | 2/2012 | Takahashi et al. | |
| 2012/0063829 | A1 | 3/2012 | Matsuyama et al. | |
| 2012/0195652 | A1 | 8/2012 | Takahashi et al. | |

FOREIGN PATENT DOCUMENTS

| | | | | | |
|---|---|---|---|---|---|
| JP | 2001-066931 | A | | 3/2001 | |
| JP | 2001125328 | A | * | 5/2001 | G03G 15/00 |
| JP | 2001240268 | A | * | 9/2001 | G03G 5/02 |
| JP | 2002002997 | A | * | 1/2002 | G03G 15/20 |
| JP | 2006-098572 | A | | 4/2006 | |
| JP | 2008197587 | A | * | 8/2008 | G03G 15/20 |
| JP | 2009-003304 | A | | 1/2009 | |

* cited by examiner

MEDIA GUIDE MECHANISM, FIXING DEVICE AND IMAGE FORMING APPARATUS INCORPORATING SAME

CROSS-REFERENCE TO RELATED APPLICATION

This patent application claims priority pursuant to 35 U.S.C. §119 to Japanese Patent Application No. 2011-146135, filed on Jun. 30, 2011, the entire disclosure of which is hereby incorporated by reference herein.

BACKGROUND OF THE INVENTION

1. Technical Field

The present invention relates to a media guide mechanism, a fixing device, and an image forming apparatus incorporating the same, and more particularly, to a mechanism for guiding a recording medium into a nip formed between a pair of rotary members, as well as a fixing device and an image forming apparatus incorporating such a media guide mechanism.

2. Background Art

In electrophotographic image forming apparatuses, such as photocopiers, facsimile machines, printers, plotters, or multifunctional machines incorporating several of those imaging functions, an image is formed by attracting toner particles to a photoconductive surface for subsequent transfer to a recording medium such as a sheet of paper. After transfer, the imaging process may be followed by a fixing process using a fixing device, which permanently fixes the toner image in place on the recording medium by melting and setting the toner with heat and pressure.

FIGS. 1A and 1B are end-on, axial views of a roller-based fixing device 100 employed in electrophotographic image formation.

As shown in FIGS. 1A and 1B, the fixing device 100 includes a pair of rotary fixing members, one being a fuser roller 110 subjected to heating, and the other being a pressure roller 120 pressed against the fuser roller 110, which together form a heated area of contact called a fixing nip N therebetween, through which a recording sheet S is passed to fix a toner image under heat and pressure.

For proper conveyance of the recording sheet S, the fixing device 100 is equipped with a sheet guide mechanism 200 upstream from the fixing nip N, including a swivelable guide plate 210 along which the sheet S is guided into the fixing nip N. The guide plate 210 has its downstream end being free, and its another, upstream end hinged to a shaft 210*a* defining a rotational axis around which the plate 210 is rotatable.

An electrically controlled solenoid 220 is connected to the guide plate 210 to control position of the plate 210 around its rotational axis depending on the thickness of recording sheet S being guided. When supplied with an electrical signal changing according to the thickness of recording medium S detected by a sensor, the solenoid 220 causes the guide plate 210 to different operational positions with respect to an imaginary reference plane X in which the fixing nip N extends.

Specifically, as shown in FIG. 1A, where the recording medium in use is a relatively thin sheet S1, such as normal copy paper, the solenoid 220 moves the guide plate 210 to a first operational position in which the free end of the guide plate 210 is directed toward the fuser roller 110 away from the reference plane X.

The guide plate 210 thus establishing the first operational position directs the recording sheet 51 toward the fuser roller 110, so that the sheet 51 enters the fixing nip N with its leading edge passing between the roller surface and the downstream end of the guide plate 210, while temporarily bowing outward away from the reference plane X before entering the fixing nip N. Such temporary bowing of the sheet 51 transversely reinforces the sheet S1 to prevent creasing or other possible damage to the resulting print upon passage through the fixing nip N.

Conversely, as shown in FIG. 1B, where the recording medium in use is a relatively thick sheet S2, such as envelope paper or paperboard, the solenoid 220 moves the guide plate 210 to a second operational position in which the free end of the guide plate 210 aligns with the reference plane X.

The guide plate 210 thus establishing the second operational position directs the recording sheet S2 along the reference plane X, so that the sheet S2 directly enters the fixing nip N. Unlike the case with the relatively thin, flexible sheet 51, the recording sheet S2 does not bow outward away from the reference plane X before entering the fixing nip N, which would otherwise cause creases on the recording sheet S2, rather than prevent them, during entry into the fixing nip N.

Various similar techniques have been proposed to provide reliable media guide mechanism. For example, one known method proposes an image forming apparatus in which a solenoid adjusts position of a guide member according to several parameters, including physical properties of a recording medium, and environmental conditions under which printing is performed. Another method proposes a paper guide device that controls position of a guide plate using several types of manual or electric actuators, such as solenoid, cam, and linear stage.

Although generally successful for their intended purposes, those approaches employing a solenoid or actuator for controlling operational position of a guide member have several drawbacks.

One drawback is that the actuator-based position control requires a complicated electromechanical assembly, which is relatively large in size and is costly to implement. Another drawback is the relatively large size of the position controller imposes limitations on the design of the media guide mechanism, which often results in reduced serviceability or maintainability of the mechanism upon installation into an image forming apparatus.

For example, in the case of a solenoid-operated guide plate, provision of a solenoid and its associated driving circuitry adjacent to the guide plate restricts positioning of the shaft or rotational axis to the upstream end of the guide plate, making it difficult to remove the guide plate from the image forming apparatus due to the presence of bearings and other components for supporting the shaft at the upstream end of the guide plate, and due to the necessity of mechanically isolating the guide plate from the solenoid actuator at the downstream end of the guide plate.

Such limitations on the design of the media guide mechanism in turn limit the flexibility in the design and add to the overall size of the image forming apparatus, particularly where efficient positioning of unitized, removable components around the fixing device is required to prevent interference between the guide plate and the surrounding structure during removal from or installation in the image forming apparatus.

SUMMARY OF THE INVENTION

Exemplary aspects of the present invention are put forward in view of the above-described circumstances, and provide a novel mechanism for guiding a recording medium into a nip formed between a first rotary member subjected to heating, and a second rotary member pressed against the first rotary member.

In one exemplary embodiment, the mechanism includes a guide member and a biasing member. The guide member is disposed upstream from the nip to guide the recording medium therealong. The biasing member is connected to the guide member to mechanically bias the guide member. The guide member is subjected to a constant biasing force from the biasing member and to a pressure force from the recording medium. The pressure force is opposite the biasing force and variable with a stiffness of the recording medium being guided. The guide member is movable to different operational positions depending on the biasing and pressure forces acting thereon.

Other exemplary aspects of the present invention are put forward in view of the above-described circumstances, and provide a fixing device incorporating a media guide mechanism.

Still other exemplary aspects of the present invention are put forward in view of the above-described circumstances, and provide an image forming apparatus incorporating a media guide mechanism.

BRIEF DESCRIPTION OF THE SEVERAL VIEWS OF THE DRAWINGS

A more complete appreciation of the disclosure and many of the attendant advantages thereof will be more readily obtained as the same becomes better understood by reference to the following detailed description when considered in connection with the accompanying drawings, wherein.

DETAILED DESCRIPTION OF THE INVENTION

Figure 1A:
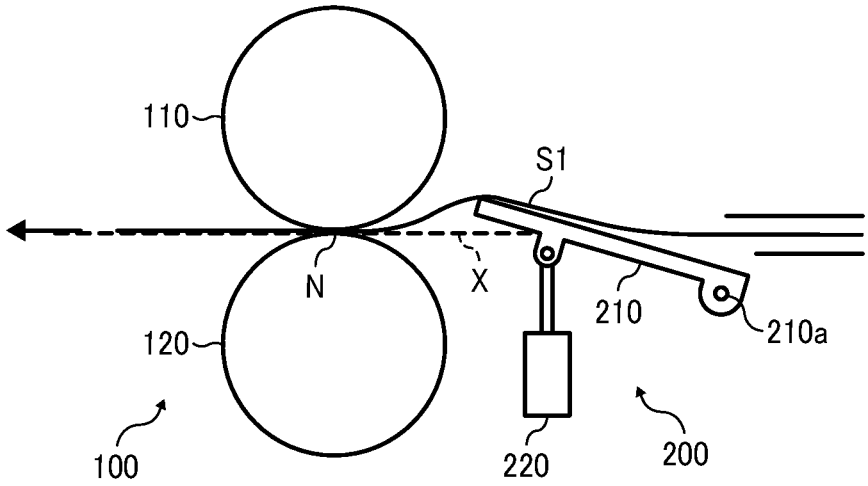
FIG. 1A BACKGROUND ART
FIGS. 1A and 1B are end-on, axial views of a roller-based fixing device employed in electrophotographic image formation.
Figure 1B:
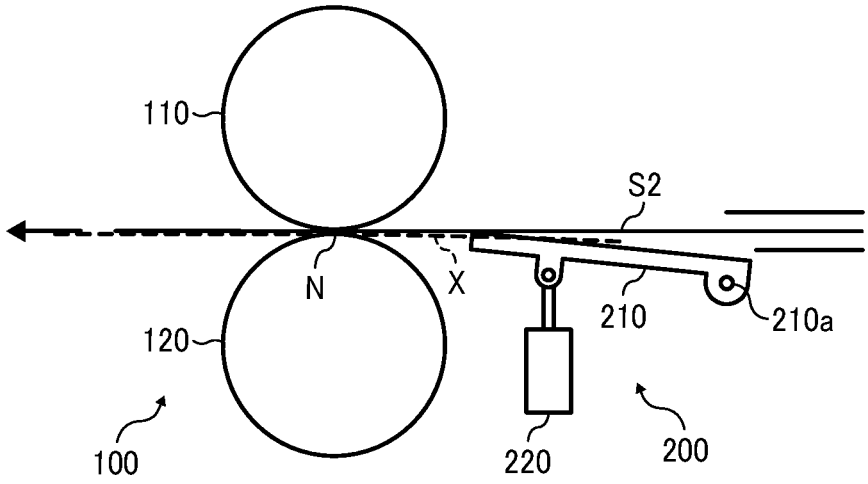
FIG. 1B BACKGROUND ART

In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views, exemplary embodiments of the present patent application are described.

Figure 2:
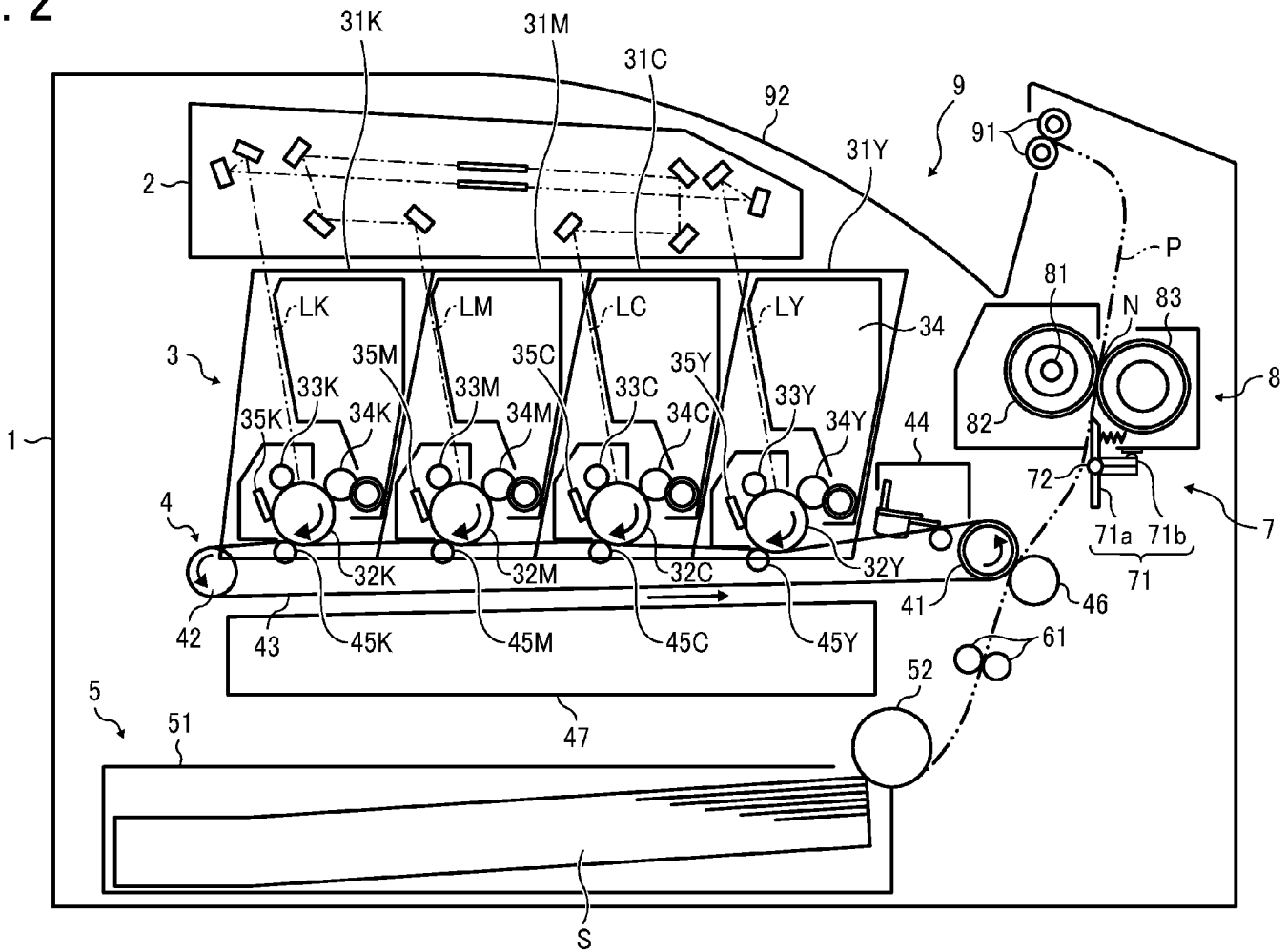
FIG. 2 schematically illustrates an image forming apparatus according to one embodiment of this patent specification.

FIG. 2 schematically illustrates an image forming apparatus 1 according to one or more embodiments of this patent specification.

As shown in FIG. 2, the image forming apparatus 1 comprises an exposure unit 2 for generating a light beam L according to image data; an imaging unit 3 having a photoconductive surface exposed to the light beam L for forming a toner image thereon; an image transfer unit 4 for transferring the toner image from the photoconductive surface to a recording medium such as a sheet of paper S; a sheet supply unit 5 for supplying the recording sheets S toward the image transfer unit 4 along a sheet conveyance path P; a fixing unit 8 for fixing the toner image in place on the recording sheet S; and an output unit 9 for outputting the recording sheet S from the apparatus body.

Specifically, in the present embodiment, the exposure unit 2 is disposed at an upper portion of the apparatus body, consisting of a light source and various pieces of optical equipment which together generate laser or light beams L modulated based on an image signal obtained by decomposing original image data, which may be captured from an original document using a suitable image scanner.

The imaging unit 3 is located below the exposure unit 2, consisting of four electrophotographic imaging stations 31Y, 31C, 31M, and 31K arranged in tandem, each of which serves to form an image with toner particles of a particular primary color, as designated by the suffixes "Y" for yellow, "C" for cyan, "M" for magenta, and "K" for black. These imaging stations 31 are of a substantially identical configuration, except for the color of toner accommodated therein, including a drum-shaped photoconductor 32 defining an outer, photoconductive surface on which a toner image is created; a charging roller 33 for uniformly charging the photoconductive surface; a development device 34 for supplying toner to the photoconductive surface; and a cleaning blade 35 for cleaning the photoconductive surface, all or part of which are integrated into a single, integral process unit removably installed into the image forming apparatus 1.

Extending below the imaging unit 3 is the image transfer unit 4, including a looped, intermediate transfer belt 43 entrained around a motor-driven roller 41 and an idler roller 42. Inside the loop of the belt 43 are four primary transfer rollers 45Y, 45C, 45M, and 45K, each pressing against an associated one of the photoconductors 31 via the belt 43 to form a primary transfer nip therebetween, at which the toner image is primarily transferred from the photoconductive surface to the intermediate transfer belt 43. Also included is a secondary transfer roller 46 pressing against the motor-driven roller 41 via the belt 43 to form a secondary transfer nip therebetween, at which the toner image is secondarily transferred from the intermediate transfer belt 43 to a recording sheet S.

A belt cleaner 44 is disposed adjacent to the intermediate transfer belt 43 downstream from the secondary transfer nip and upstream from the four primary transfer nips to remove toner and other residues from the belt surface after image transfer. The belt cleaner 44 is connected to a waste toner container 47 via a suitable toner conduit or hose equipped with a screw propeller, which transfers residual particles from the belt cleaner 44 for collection into the waste toner container 47.

At a lower portion of the apparatus body is the sheet supply unit 5, including a sheet tray 51 accommodating a stack of recording sheets S, and a feed roller 52 disposed on the sheet tray 51 for feeding a recording sheet S into the sheet conveyance path P. The sheet conveyance path P extends vertically upward from the sheet supply unit 5, along which a pair of registration rollers 61 as well as various conveyance rollers and guide plates are deployed to forward the recording sheet S to the image transfer unit 4, then to the fixing unit 8, and then finally to the output unit 9.

The fixing unit 8 is located downstream from the secondary transfer nip along the sheet conveyance path P, including a first rotary member 82 subjected to heating with a heater 81, and a second rotary member 83 pressed against the first rotary member 82 to form a fixing nip N therebetween, through which the recording sheet S is passed to fix the toner image in place with heat and pressure.

According to this patent specification, the image forming apparatus comprises a media guide mechanism 7 disposed between the image transfer unit 4 and the fixing unit 8 to guide a recording medium or sheet S into the fixing nip N. A detailed description of the sheet guide mechanism 7 and its associated structure will be given later with reference to FIGS. 3A and 3B and subsequent drawings.

The output unit 9 is disposed at a top of the apparatus body, including a pair of output rollers 91 and an output sheet tray 92 for stacking the recording sheet S outside the apparatus body.

During operation, to form a full-color image according to image data, each imaging station 31 rotates the photoconductor drum 32 clockwise in the drawing to forward its outer, photoconductive surface to a series of electrophotographic processes, including charging, exposure, development, transfer, and cleaning, in one rotation of the photoconductor drum.

First, the photoconductive surface is charged to a given uniform potential by the charging roller 33 and subsequently exposed to a laser beam L emitted from the exposure device 2, which is modulated based on an image signal for a particular primary color obtained by decomposing the original image data into primary color components. The laser exposure selectively dissipates the charge on the photoconductive surface to form an electrostatic latent image thereon. Then, the latent image enters the development device 34 which renders the incoming image visible using toner. The toner image thus obtained is forwarded to the primary transfer nip between the primary transfer roller 45 and the photoconductor 32.

In the image transfer unit 4, the intermediate transfer belt 43 rotates counterclockwise in the drawing. At the primary transfer nip, the primary transfer roller 45 is electrified with a constant, current-controlled or voltage-controlled bias voltage of a potential opposite that of the toner being charged to form a primary transfer field between the photoconductor 32 and the primary transfer roller 45, under which the toner image is transferred from the photoconductor 32 to the intermediate transfer belt 43.

As the multiple imaging stations 31 sequentially produce toner images of different colors at the four transfer nips along the belt travel path, the primary toner images are superimposed one atop another to form a single multicolor image on the moving surface of the intermediate transfer belt 43 for subsequent entry to the secondary transfer nip between the secondary transfer roller 46 and the motor-driven roller 41.

Meanwhile, in the sheet supply unit 5, the feed roller 52 introduces a recording sheet S from the sheet tray 51 into the sheet conveyance path P. Upon entering the sheet conveyance path P, the recording sheet S reaches the pair of registration rollers 13 being rotated, which upon receiving the incoming sheet S, stops rotation to hold the sheet S therebetween, and then advances it in sync with the movement of the intermediate transfer belt 43 to the secondary transfer nip.

At the secondary transfer nip, the secondary transfer roller 46 is electrified with a bias voltage of a potential opposite that of the toner being charged to form a secondary transfer field between the motor-driven roller 41 and the secondary transfer roller 46, under which the multicolor toner image is transferred from the intermediate transfer belt 43 to the recording sheet S. The intermediate transfer belt 43 after exiting the secondary transfer nip reaches the belt cleaner 44, which cleans the belt surface of untransferred, residual toner, followed by the waste toner conduit transferring toner residues from the belt cleaner 44 to the waste toner container 47.

After secondary transfer, the recording sheet S is advanced to the sheet guide mechanism 7, along which the recording sheet S is guided toward the fixing unit 8. In the fixing unit 8, the incoming sheet S is passed through the fixing nip N to fix the toner image in place with heat and pressure. The recording sheet S after fixing separates from the fixing roller 82 to meet the output roller pair 91 which then outputs the incoming sheet S to the output tray 92 for stacking outside the apparatus body, which completes one operational cycle of the image forming apparatus 1.

Although the embodiment above describes an operation in which the image forming apparatus 1 reproduces a full-color image using all the four color imaging stations 31Y, 31C, 31M, and 31K, the image forming apparatus 1 may operate in different modes of operation, such as a monochrome printing mode in which only a single imaging station is selectively activated to form a monochrome image, as well as a dual- or tri-color printing mode in which two or three imaging stations are selectively activated to form a multicolor image, depending on a specific print job submitted.

Figure 3A:
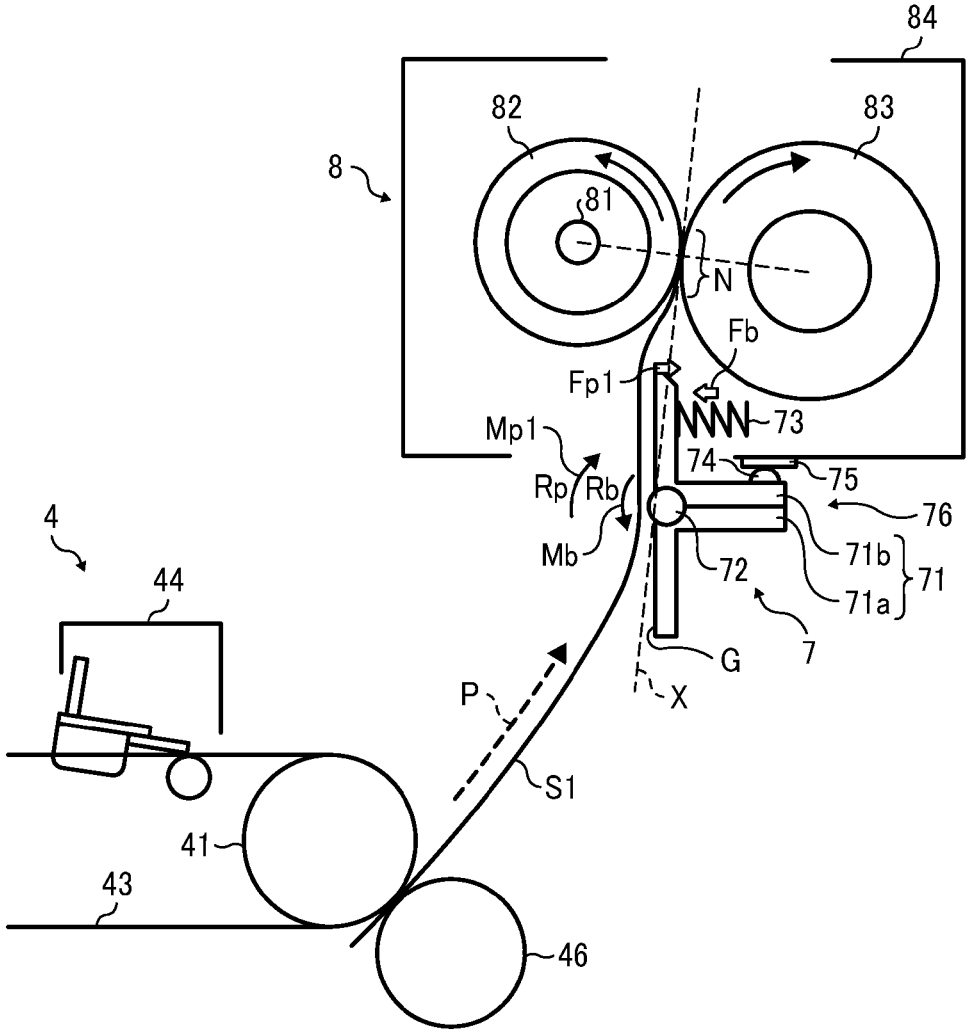
FIGS. 3A and 3B are end-on, axial views of a fixing device including a media guide mechanism according to one or more embodiments of this patent specification.
Figure 3B:
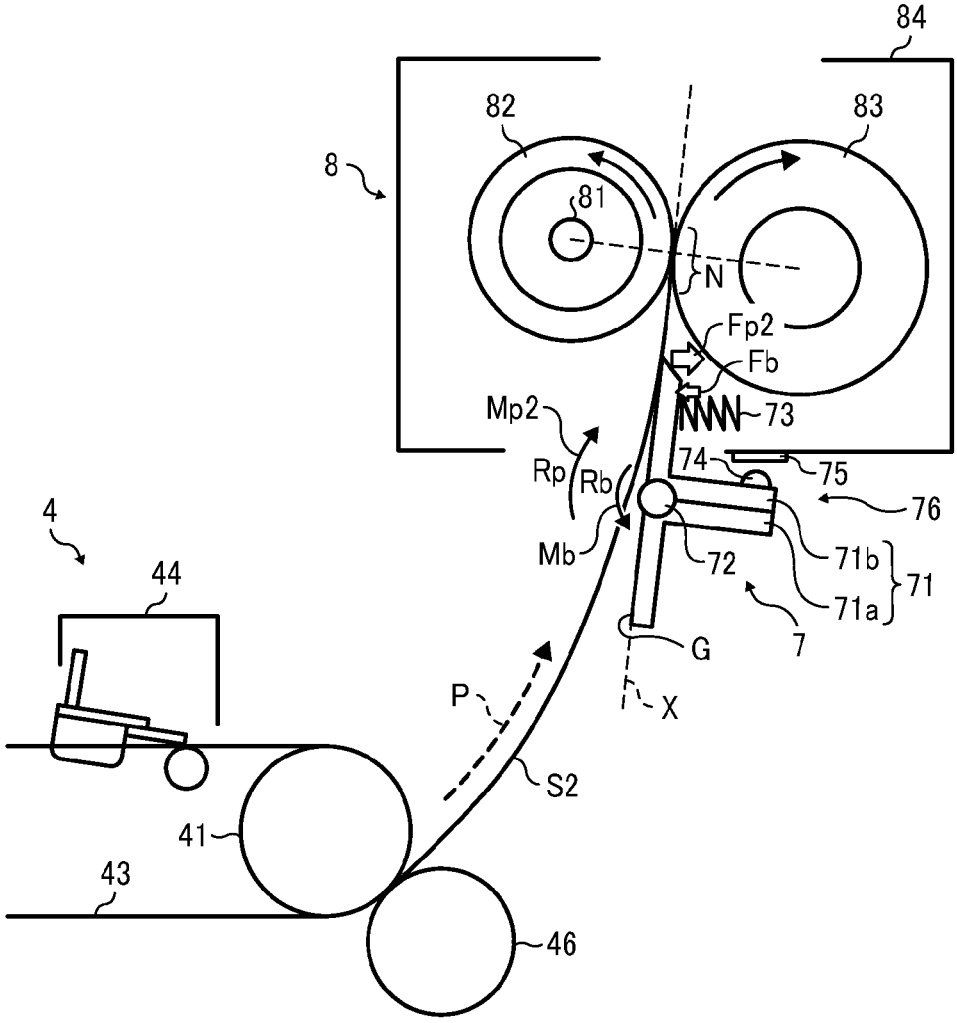

FIGS. 3A and 3B are end-on, axial views of the fixing unit 8 according to one or more embodiments of this patent specification.

As shown in FIGS. 3A and 3B, the fixing unit 8 includes a first rotary member or fuser roller 82 subjected to heating, and a second rotary member or pressure roller 83 disposed opposite the first rotary member 82. The pressure roller 83 is pressed against the fuser roller 82 to form a fixing nip N therebetween, through which a recording sheet S is passed under heat and pressure.

Inside the fixing roller 82 is a heater 81 which internally heats the fixing roller 82. The pressure roller 83 is equipped with a suitable roller biasing mechanism, which allows for adjustably positioning the pressure roller 83 relative to the fuser roller 82 to adjust a width and strength of the fixing nip N therebetween.

Optionally, the fixing unit 8 may have a temperature sensor, such as a thermistor or a thermostat of a computer-controlled temperature control system, disposed adjacent to the fuser roller 83 to measure temperature at an outer surface of the roller 83. A controller, such as a central processing unit (CPU) with associated memory devices, may be provided to control operation of the heater 81 according to readings of the temperature sensor to maintain the roller temperature within a desired temperature range.

Components of the fixing unit 8 depicted above may be enclosed in a stationary frame or housing 84 which defines a space into which the fixing unit 8 is accommodated for installation in the image forming apparatus 1. The rotary fixing members 82 and 83 have their respective ends rotatably supported on the stationary housing 84.

Specifically, in the present embodiment, the fuser roller 82 comprises a heat-conductive, hollow cylindrical substrate covered with an inner, elastic layer and an outer, protective layer deposited one upon another on the substrate surface.

The cylindrical substrate of the roller 82 may be formed of metal that exhibits a sufficient mechanical strength and a high thermal conductivity, such as carbon steel, aluminum, alloys of these metals, or the like. The elastic layer of the roller 82 may be formed of a deposit of elastic, synthetic rubber, such as silicone rubber, fluorine rubber, or the like. The protective layer of the roller 82 may be formed of an external covering or layer of material that exhibits a high durability and a high thermal conductivity, such as a tubular cover of perfluoroalkoxy (PFA), a coating of PFA or polytetrafluoroethylene (PTFE), or a deposit of silicon rubber or fluorine rubber formed upon the elastic layer, which effectively prevents undesired adhesion of toner to the roller surface for ready separation of the recording medium from the fuser roller, while enabling the inner elastic layer of the roller to resist wear and tear over an extended period of use.

The pressure roller 83 comprises a cylindrical core of metal covered with an inner, elastic layer and an outer, protective layer deposited one upon another on the metal surface.

The metal core of the roller 83 may be formed of suitable metal, such as those defined in Japanese Industrial Standard (JIS) for carbon steel tube for machine structural purpose. The elastic layer of the roller 83 may be formed of resin, such as silicone rubber, fluorine rubber, or the like, either in solid or foamed forms. The protective layer of the roller 83 may be formed of a tubular cover of PFA, PTFA, or a similar heat-resistant fluorine resin, which effectively prevents undesired adhesion of toner to the roller surface.

During operation, a recording sheet S onto which a toner image is transferred moves from the image transfer unit 4 toward the fixing unit 8, as the motor-driven roller 41 advances the sheet S along the sheet conveyance path P. Upon entering the fixing unit 8, the recording sheet S passes through the fixing nip N with its printed surface facing the fuser roller 82 and another, opposite surface facing the pressure roller 83, which causes the toner image T to fix in place on the recording sheet S, as the toner particles soften and melt under heat from the fuser roller 82 and pressure between the opposed rollers 82 and 83. Upon exiting the fixing nip N, the recording sheet S separates from the fuser roller 82 to reach a suitable conveyance mechanism, which forwards the incoming sheet S toward the output unit 9.

With continued reference to FIGS. 3A and 3B, the sheet guide mechanism 7 is shown disposed between the image transfer unit 4 and the fixing unit 8 along the sheet conveyance path P.

As shown in FIGS. 3A and 3B, the sheet guide mechanism 7 includes a guide member 71 disposed upstream from the nip N to guide the recording sheet S therealong, and a biasing member 73 connected to the guide member 71 to mechanically bias the guide member 71.

In the present embodiment, the guide member 71 comprises a swivelable plate assembly, including a shaft 72 for defining a rotational axis around which the guide member 71 is rotatable, and a pair of upstream and downstream guide plates 71*a* and 71*b* arranged in series in a direction in which the recording sheet S is conveyed to together define a smooth, continuous guide surface G along which the recording sheet S is guided.

As used herein, the terms "upstream" and "downstream" refer to relative positions of components arranged in series in a direction in which the recording sheet S is conveyed from the secondary transfer nip toward the fixing nip N. In particular, these directional terms are used to describe those portions of the guide member 71 arranged in series along the sheet conveyance path P. That is, that the upstream guide plate 71*a* is closer to the secondary transfer nip and farther from the fixing nip N than the downstream guide plate 71*b*, such that the recording sheet S exiting the secondary transfer nip comes into contact initially with the upstream guide plate 71*a* and then with the downstream guide plate 71*b* for subsequent entry into the fixing nip N.

Specifically, the pair of upstream and downstream guide plates 71*a* and 71*b* each comprises an elongated piece of suitable material, such as resin or metal, having an L-shaped cross section formed of two flat, mutually perpendicular walls, one of which coincides with that of the other guide plate, and the other of which aligns flush with that of the other guide plate, so as to together form a T-shaped cross-section of the guide member 71.

The pair of upstream and downstream guide plates 71*a* and 71*b* is connected together with a removable fastener for integration into a single integrally movable unit which retains the smooth, continuous configuration of the guide surface G upon rotation of the guide member 71.

Any suitable fastening device that can be attached and detached easily may be employed to connect the guide plates 71*a* and 71*b* together. Examples include snap-fit fasteners such as a cantilever joint formed of an elastic deflectable hook and a recess, each provided in one of the plate pair, to establish mechanical engagement therebetween, or a pin-and-hole joint formed of an insert and a hole, each provided in one of the plate pair, to establish frictional engagement therebetween.

The shaft 72 is disposed at an interface at which the guide plates 71*a* and 71*b* meet each other, such that the rotational axis of the guide member 71 extends along a substantial center of the guide surface G in the sheet conveyance direction. A pair of opposed longitudinal ends of the shaft 72 is connected to a stationary structure via bearings, which allows the guide member 71 to swivel around the rotational axis where a suitable force acts on the guide member 71. The shaft 72 is affixed to the downstream guide plate 71*b* but not to the upstream guide plate 71*a*.

In the present embodiment, the biasing member 73 comprises an elastic element coupled to or integral with the guide member 71 to impart an elastic biasing force to the guide member 71.

The biasing member 73 is formed of a resilient, elastic material, such as a coil or rubber spring, disposed either in a stretched or compressed state, which can impart a constant, sufficient biasing force to the guide member 71 within a predetermined range of motion when subjected to a suitable load, such as tension, compression, or torsion, depending on a specific configuration of the biasing member 73. For example, the elastic element 73 may be a compression spring disposed, in a compressed state, on the downstream guide plate 71*b*, so as to elastically bias the guide member 71 constantly in a direction counterclockwise in the drawing.

In such a configuration, the sheet guide mechanism 7 according to this patent specification can control operational position of the guide member 71 depending on the type of recording medium S being guided, where the fixing unit 8 accommodates various types of recording media for processing through the fixing nip N, each of which has a specific thickness, size, and shape to exhibit a specific stiffness (i.e., the bending stiffness with which the recording medium can resist bending where a force is applied perpendicular to the media surface).

With still continued reference to FIGS. 3A and 3B, the guide member 71 is shown subjected to a constant biasing force Fb from the biasing member 73 and to a pressure force Fp from the recording sheet S. The pressure force Fp is opposite the biasing force Fb and variable with, or substantially proportional to, a stiffness of the recording sheet S being guided. The guide member 71 is movable to different operational positions depending on the biasing and pressure forces acting thereon, so as to establish a first operational position where the biasing force Fb exceeds the pressure force Fp (FIG. 3A), and a second operational position, different from the first operational position, where the pressure force Fp exceeds the biasing force Fb (FIG. 3B).

In the present embodiment, the variable pressure force Fp applied from the recording medium S on the rotatable guide member 71 produces a corresponding moment Mp on the guide member 71 around the rotational axis 72 in a first rotational direction Rp (i.e., clockwise in the drawing), whereas the constant biasing force Fp applied from the biasing member 73 on the rotatable guide member 71 produces a corresponding moment Mb on the guide member 71 around the rotational axis 72 in an opposite, second rotational direction Rb (i.e., counterclockwise in the drawing). The moments Mp and Mb of the rotating forces Fp and Fb thus applied to the guide member 71 causes the guide member 71 to establish a particular operational position depending on relative magnitudes of the opposed moments Mp and Mb.

For example, the guide member 71 may be more inclined toward the fuser roller 82 away from a common tangential, reference plane X between the first and second rotary members 82 and 83 (that is, an imaginary flat plane in which the fixing nip N extends) where the guide member 71 is in the first operational position thereof than where the guide member 71 is in the second operational position thereof.

Specifically, as shown in FIG. 3A, where the recording medium being guided is a relatively thin, flexible sheet 51 of material, such as normal copy paper, the pressure force Fp exerted on the guide member 71 is relatively low, resulting in a relatively low moment Mp1 in the first rotational direction Rp lower than the moment Mb in the second rotational direction Rb, causing the guide member 71 to be inclined toward the fuser roller 82 away from the reference plane X.

The guide member 71 thus establishing the first operational position directs the recording sheet S1 away from the reference plane X toward the fuser roller 82, so that the sheet S1 initially contacts the fuser roller 82, and subsequently, with its leading edge passing between the roller surface and the downstream end of the guide member 71, enters the fixing nip N.

The recording sheet S1 guided by the guide member 71 in the first operational position temporarily bows outward toward the fuser roller 82 before entering the fixing nip N. Such temporary bowing of the sheet S1 transversely reinforces the sheet S1 during entry into the fixing nip N, enabling it to retain its original, flat configuration without creasing or other possible damage to the resulting print upon passage through the fixing nip N.

Conversely, as shown in FIG. 3B, where the recording medium being guided is a relatively thick, stiff sheet S2 of material, such as envelope paper or paperboard, the pressure force Fp exerted on the guide member 71 is relatively high, resulting in a relatively high moment Mp2 in the first rotational direction Rp higher than the moment Mb in the second rotational direction Rb, causing the guide member 71 to be inclined toward the reference plane X away from the fuser roller 82. In particular, the guide member 71 at least partially aligns with the reference plane X where the recording medium in use is a relatively thick, stiff sheet of paper with a grammage of equal to or greater than 100 grams per square meter ($g/m^2$).

The guide member 71 thus establishing the second operational position directs the recording sheet S2 toward the reference plane X away from the fuser roller 82, so that the sheet S2 gradually approaches the reference plane X to directly enter the fixing nip N without contacting the fuser roller 82.

Unlike the case with the relatively thin, flexible sheet S1, the recording sheet S2 guided by the guide member 71 in the second operational position does not bow outward toward the fuser roller 82 before entering the fixing nip N, which would otherwise cause creases on the recording sheet S2, rather than prevent them, during entry into the fixing nip N. Owing to the lack of contact with the fuser roller 82 and owing to its inherent stiffness, the recording sheet S2 can retain its original, flat configuration without creasing or other possible damage to the resulting print upon passage through the fixing nip N.

Thus, the sheet guide mechanism 7 according to this patent specification allows for optimizing operational position of the guide member 71 depending on the thickness or stiffness of recording medium S being guided. For proper optimization of the operational position of the guide member 71, the biasing force Fb is suitably determined such that the resulting moment Mb imparted to the guide member 71 exceeds the moment Mp1 resulting from pressure from a relatively thin, flexible sheet S1, and falls below the moment Mp2 resulting from pressure from a relatively thick, stiff sheet S2.

Preferably, the biasing force Fb does not fall below a lowest possible limit determined according to a maximum allowable thickness or stiffness of recording medium that can be accommodated in the fixing unit 8, so that the guide member 71 is reliably positioned without deflection toward the pressure roller 83 away from the reference plane X regardless of the type of recording medium being guided, which would otherwise result in an undesired interference between the recording medium S and the pressure roller 83.

Further, in the present embodiment, the guide mechanism 7 includes a rotational motion restrictor 76 to retain the guide member 71 in position upon establishment of at least one of the first and second operational positions.

Specifically, the rotational motion restrictor 76 is formed of a pair of contact portions 74 and 75 provided on the adjoining surfaces of the guide member 71 and the stationary housing 84 of the fixing unit 8 on which the first and second rotary members 82 and 83 are supported. The contact portions 74 and 75 may be configured as a combination of a flange and a protrusion, which contact each other to restrict further rotation of the guide member 71 in the second rotational direction Rb where the first operational position is established. A similar mechanism may also be provided to restrict further rotation of the guide member 71 in the first rotational direction Rp where the second operational position is established.

Providing the contact portion 75 on the stationary structure 84 of the fixing unit 8 allows for positioning the guide mechanism 7 extremely close to the fixing unit 8, leading to a compact size of the imaging system incorporating the guide mechanism 7 according to this patent specification.

Furthermore, in the present embodiment, the guide member 71 is formed of a pair of upstream and downstream portions detachably attached to each other during assembly of the guide member 71. The upstream portion is detachable from the downstream portion without removing the downstream portion from the mechanism during disassembly of the guide member 71.

Specifically, as mentioned earlier, the pair of upstream and downstream guide plates 71*a* and 71*b* of the guide member 71 is connected together with a removable fastener for integration into a single integrally movable unit, with the shaft 72 affixed to the downstream guide plate 71*b* but not to the upstream guide plate 71*a*. Thus, by removing the fastener between the guide plates 71*a* and 71*b*, the upstream guide plate 71*a* is detachable from the downstream guide plate 71*b* and from the shaft 72 without removing the downstream guide plate 71*b* from the guide mechanism 7 during disassembly of the guide member 71.

Figure 4:
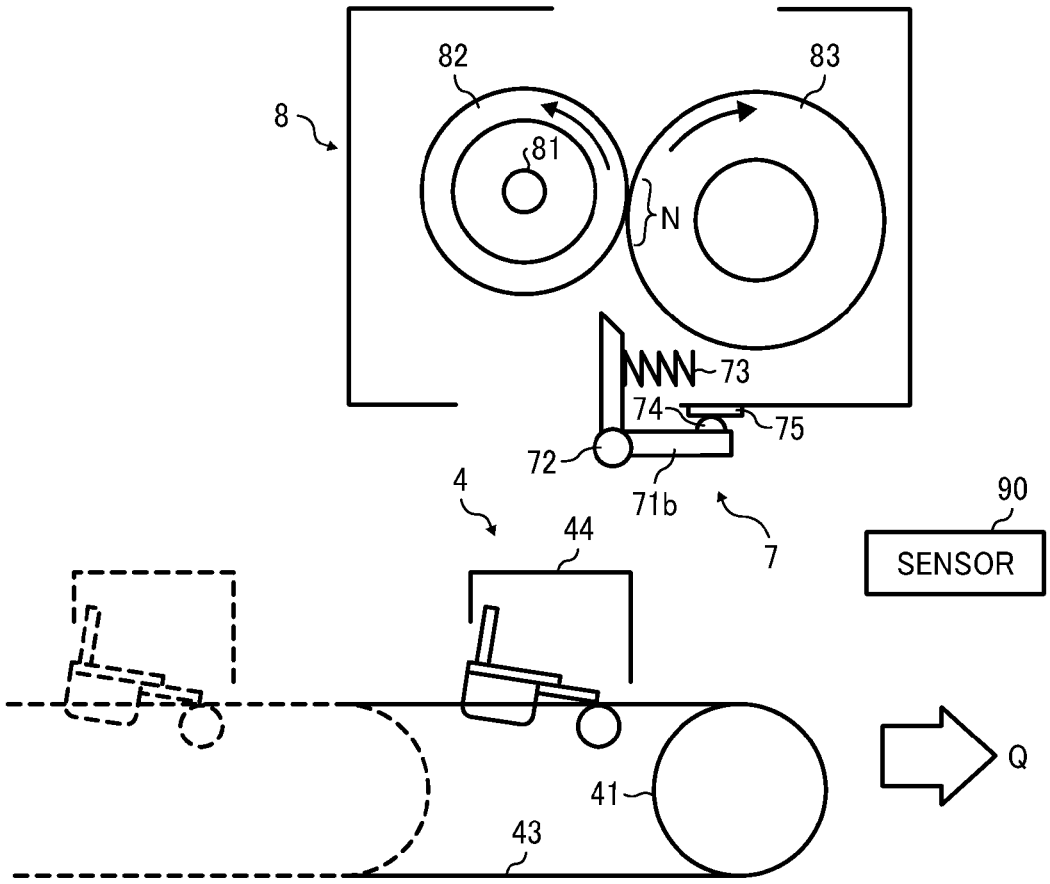
FIG. 4 is another end-on axial view of the fixing device of FIGS. 3A and 3B.

FIG. 4 is another end-on axial view of the fixing unit 8, shown with the guide member 71 disassembled by detaching the upstream guide plate 71*a* from the downstream guide plate 71*b*.

As shown in FIG. 4, detachment of the upstream guide plate 71*a* leaves a space below the fixing unit 8, through which a surrounding structure, such as, for example, the image transfer unit 4 with its intermediate transfer belt 43, may be movable in a lateral direction Q traversing the sheet conveyance path P for removal from or installation into the image forming apparatus 1 to facilitate maintenance of the image transfer unit 4. Such arrangement allows for positioning a removably installed unit extremely close to the fixing unit 8 and the sheet guide mechanism 7, leading to compact size and high design flexibility of the image forming apparatus 1.

Additionally, the sheet guide mechanism 7 may be provided with a sensor 90 adjacent to the guide member 71 to detect whether the upstream portion is detached from the downstream portion of the guide member 71. Provision of the sensor 90 allows a user to ensure that the guide member 71 is properly re-assembled by attaching the upstream guide member 71*a* to the downstream guide member 71*b* after maintenance of the removably installed unit, so as to prevent misassembly and misuse of the equipment without the upstream guide member 71*a* attached to the downstream guide member 71*b*.

Although in several embodiments described above, the media guide mechanism 7 employs an elastic biasing member to mechanically bias the guide member, the biasing member may be configured as any suitable biasing structure that provides resilience or self-recovery capability with which the guide member 71 returns to its original operational position without an external actuator to induce movement of the guide member 71 after changing position from the first operational position to the second operational position during passage of a recording medium.

For example, instead of an elastic spring, the biasing member 73 may be a weight coupled to or integral with the guide member 71 to impart a gravitational biasing force to the guide member 71. Such gravity-based biasing may be accomplished by connecting a suitable weight to the guide member 71 or by modifying the position of the rotational axis of the guide member 71 to cause the guide member 71 to remain in the first operational position by gravity upon passage of a relatively thin, elastic sheet, and move to the second operational position upon passage of a relatively thick, stiff sheet.

Using a gravitational biasing force in place of an elastic biasing force is superior in terms of simplicity in design, as it does not necessitate inclusion of an elastic or other external biasing element in the guide mechanism 7.

Hence, the guide mechanism 7 according to this patent specification can effectively guide a recording medium into a nip N formed between a first rotary member 82 subjected to heating, and a second rotary member 83 pressed against the first rotary member 82, owing to simple, inexpensive position control that enables a guide member 71 to move to different operational positions depending on a constant biasing force from a biasing member and a pressure force from a recording medium.

Compared to a positioning device that employing a solenoid or actuator, such non-electric position control depending on the forces acting on the guide member 71 allows for a simple, inexpensive configuration of the guide mechanism 7. The compact position controller formed of the biasing member, and optionally the motion restrictor, can be accommodated within a small space defined between the downstream end of the guide member 71 and the adjoining surface of the fixing unit 8, leading to greater flexibility in designing the upstream end of the guide member 71.

Moreover, forming the guide member 71 of a pair of upstream and downstream portions detachably attached to each other allows for ready disassembly and re-assembly of the guide plate. Such arrangement leads to increased serviceability or maintainability of the mechanism upon installation into an image forming apparatus, which in turn allows for high flexibility in the design and compact overall size of the image forming apparatus, particularly where efficient positioning of unitized, removable components around the fixing device is required.

Numerous additional modifications and variations are possible in light of the above teachings. For example, although in several embodiments described herein, the image forming apparatus is configured as a tandem multicolor printer, the configuration of the image forming apparatus is not limited to that described herein, and includes various types of monochrome or multicolor imaging equipment, such as such as photocopiers, facsimile machines, printers, plotters, or multifunctional machines incorporating several of those imaging functions. It is therefore to be understood that, within the scope of the appended claims, the disclosure of this patent specification may be practiced otherwise than as specifically described herein.

What is claimed is:

1. A mechanism for guiding a recording medium into a nip formed between a first rotary member subjected to heating, and a second rotary member pressed against the first rotary member, the mechanism comprising:

a guide member disposed upstream from the nip to guide the recording medium therealong; and a biasing member connected to the guide member to mechanically bias the guide member, the guide member being subjected to a constant biasing force from the biasing member and to a pressure force from the recording medium, the pressure force being opposite the biasing force and variable with a stiffness of the recording medium being guided, the guide member being movable to different operational positions depending on the biasing and pressure forces acting thereon, wherein the guide member comprises:

a shaft defining a rotational axis around which the guide member is rotatable;

a pair of upstream and downstream guide plates arranged in series in a direction in which the recording medium is conveyed to together define a smooth, continuous guide surface along which the recording medium is guided, and the shaft is affixed to the downstream guide plate but not to the upstream guide plate.

2. The mechanism according to claim 1, wherein the guide member establishes a first operational position where the biasing force exceeds the pressure force, and a second operational position, different from the first operational position, where the pressure force exceeds the biasing force.

3. The mechanism according to claim 2, wherein the guide member is more inclined toward the first rotary member away from a common tangential, reference plane between the first and second rotary members where the guide member is in the first operational position thereof than where the guide member is in the second operational position thereof.

4. The mechanism according to claim 3, wherein the guide member directs the recording medium toward the first rotary member away from the reference plane where the guide member is in the first operational position thereof, and toward the reference plane away from the first rotary member where the guide member is in the second operational position thereof.

5. The mechanism according to claim 3, wherein the guide member at least partially aligns with the reference plane where the recording medium in use is a relatively thick, stiff sheet of paper with a grammage of equal to or greater than 100 grams per square meter.

6. The mechanism according to claim 1, wherein the guide member is formed of a pair of upstream and downstream portions detachably attached to each other.

7. The mechanism according to claim 6, wherein the upstream portion is detachable from the downstream portion without removing the downstream portion from the mechanism.

8. The mechanism according to claim 6, further comprising a sensor adjacent to the guide member to detect whether the upstream portion is detached from the downstream portion.

9. The mechanism according to claim 1, wherein the pair of upstream and downstream guide plates each comprises an elongated piece having an L-shaped cross section formed of two flat, mutually perpendicular walls, one of which coincides with that of the other guide plate, and the other of which aligns flush with that of the other guide plate, so as to together form a T-shaped cross-section of the guide member.

10. The mechanism according to claim 1, wherein the pair of upstream and downstream guide plates is removably connected together for integration into a single integrally movable unit which retains the smooth, continuous configuration of the guide surface upon rotation around the rotational axis thereof.

11. The mechanism according to claim 1, wherein the biasing member includes an elastic element coupled to or integral with the guide member to impart an elastic biasing force to the guide member.

12. The mechanism according to claim 11, wherein the elastic element is selected from the group consisting of a tension spring, a compression spring, a torsion spring, and any combination thereof.

13. The mechanism according to claim 1, wherein the biasing member includes a weight coupled to or integral with the guide member to impart a gravitational biasing force to the guide member.

14. The mechanism according to claim 1, further comprising a motion restrictor to retain the guide member in position upon establishment of at least one of the first and second operational positions.

15. The mechanism according to claim 14, wherein the motion restrictor is disposed on a stationary structure on which the first and second rotary members are supported.

16. A fixing device comprising:

a first rotary member subjected to heating;

a second rotary member opposite the first rotary member, the second rotary member pressed against the first rotary member to form a fixing nip therebetween through which a recording medium is passed under heat and pressure; and a mechanically biased, guide member disposed upstream from the fixing nip for guiding the recording medium therealong into the fixing nip, the guide member being subjected to a constant biasing force and to a pressure force that is opposite the biasing force and variable with a stiffness of the recording medium being guided, the guide member being movable to different operational positions depending on the biasing pressure forces acting thereon, wherein the guide member comprises:

a shaft defining a rotational axis around which the guide member is rotatable;

a pair of upstream and downstream guide plates arranged in series in a direction in which the recording medium is conveyed to together define a smooth, continuous guide surface along which the recording medium is guided, and the shaft is affixed to the downstream guide plate but not to the upstream guide plate.

17. An image forming apparatus comprising:

a toner image forming device to form an image on a photoconductive surface;

an image transfer unit to transfer the toner image from the photoconductive surface to a recording medium;

a fixing unit downstream from the image transfer unit, having a pair of first and second rotary members to form a fixing nip therebetween through which a recording medium is passed to fix the toner image in place with heat and pressure; and a media guide mechanism disposed between the image transfer unit and the fixing unit to guide the recording medium into the fixing nip, the mechanism comprising:

a guide member disposed upstream from the fixing nip to guide the recording medium therealong; and a biasing member connected to the guide member to mechanically bias the guide member, the guide member being subjected to a constant biasing force from the biasing member and to a pressure force from the recording medium, the pressure force being opposite the biasing force and variable with a stiffness of the recording medium being guided, the guide member being movable to different operational positions depending on the biasing pressure forces acting thereon, wherein the guide member comprises:

a shaft defining a rotational axis around which the guide member is rotatable;

a pair of upstream and downstream guide plates arranged in series in a direction in which the recording medium is conveyed to together define a smooth, continuous guide surface along which the recording medium is guided, and the shaft is affixed to the downstream guide plate but not to the upstream guide plate.

* * * * *